US005572788A

United States Patent [19]

Saitoh et al.

[11] Patent Number: 5,572,788

[45] Date of Patent: Nov. 12, 1996

[54] COIL DEVICE

[75] Inventors: Yutaka Saitoh; Shinichiro Ito; Yukiharu Kinoshita, all of Tokyo, Japan

[73] Assignee: TDK Corporation, Tokyo, Japan

[21] Appl. No.: 252,368

[22] Filed: Jun. 1, 1994

Related U.S. Application Data

[63] Continuation of Ser. No. 922,693, Jul. 30, 1992, Pat. No. 5,345,209.

[51] Int. Cl.[6] ..... H01F 41/06

[52] U.S. Cl. ..... 29/605; 29/593; 29/606

[58] Field of Search ..... 29/602.1, 593, 29/606, 605; 336/83, 178, 212, 134, 136

[56] References Cited

U.S. PATENT DOCUMENTS

| | | |
|---|---|---|
| 2,130,815 | 9/1938 | Riepka . |
| 2,174,355 | 9/1939 | Sundstrom . |
| 2,413,201 | 12/1946 | Tillman . |
| 2,457,806 | 1/1949 | Crippa . |
| 2,494,579 | 1/1950 | Pimlott et al. . |
| 2,801,293 | 7/1957 | Howell et al. . |
| 2,946,029 | 7/1960 | Abrams et al. . |
| 3,078,429 | 2/1963 | Wiesner . |
| 3,197,167 | 7/1965 | Sturgis . |
| 3,209,294 | 9/1965 | Cornell . |
| 3,259,861 | 7/1966 | Walker . |
| 3,471,815 | 10/1969 | Grant et al. . |
| 3,480,896 | 11/1969 | Neuman . |
| 3,750,069 | 7/1973 | Renskers . |
| 4,377,548 | 3/1983 | Pierpont . |
| 4,558,295 | 12/1985 | Olmsted et al. . |
| 4,866,409 | 9/1989 | Umezaki . |

FOREIGN PATENT DOCUMENTS

| | | |
|---|---|---|
| 43451 | 6/1934 | France . |
| 658259 | 4/1938 | Germany . |
| 51-62741 | 5/1976 | Japan . |
| 51-75545 | 6/1976 | Japan . |
| 55-50372 | 12/1980 | Japan . |
| 56-24363 | 6/1981 | Japan . |
| 58-33810 | 2/1983 | Japan . |
| 59-217311 | 12/1984 | Japan . |
| 879940 | 10/1961 | United Kingdom . |
| 887204 | 1/1962 | United Kingdom . |
| 1054341 | 1/1967 | United Kingdom . |

*Primary Examiner*—Carl E. Hall

*Attorney, Agent, or Firm*—Knobbe, Martens, Olson & Bear

[57] ABSTRACT

A method for adjusting inductance of a coil device of a closed structure wherein the coil device outside magnetic substance forming an endless loop, an inside magnetic substance formed inside of the outside magnetic substance and a coil wound on the periphery of the inside magnetic substance. The coil device further includes gaps between both ends of the outside magnetic substance and the inside magnetic substance, and notches or holes in the outside magnetic substance. In adjusting the inductance of the coil device, a jig is inserted through the notches or holes so as to shift the position of the inside magnetic substance with respect to the outside magnetic substance.

9 Claims, 5 Drawing Sheets

COIL DEVICE

This is a continuation application of the U.S. patent application Ser. No. 07/922,693 filed Jul. 30, 1992 entitled "COIL DEVICE", now U.S. Pat. No. 5,345,209.

FIELD OF THE INVENTION

This invention relates to a coil device having a ferrite core utilized in various types of coil devices such as a transformer or a choke coil.

BACKGROUND OF THE INVENTION

Conventionally, as a magnetic core having a gap used for the transformer and the choke coil has been utilized as follows: an opposed pair of E-shaped cores made from magnetic materials such as ferrite, which is disclosed in Japanese Patent Publication No. 50372/1980, wherein gaps are provided in the end of a center leg so as to prevent magnetic saturation, or a combination of E-shaped and I-shaped core which is disclosed in Japanese Patent Publication No. 24363/1981, wherein the similar gaps as described above are provided in the end of the center leg of the E-shaped core.

However, such conventional magnetic cores having gaps, used in a choke coil or a transformer having a wire wound on the center leg often cause errors in inductance, which is most often derived from errors in the dimension of the magnetic core, errors during the production of the gaps and errors in magnetic permeability of the core. For example, when an effective permeability is 100, the variation of the inductance of the choke coil is ±21% in E-E type (disclosed in Japanese Patent Publication 50372/1980), and is ±16% in E-I type (disclosed in Japanese Patent Publication 24363/1981).

SUMMARY OF THE INVENTION

In view of the foregoing facts, an objective of the present invention is to provide a coil device whereby it is possible to adjust the variation of inductance.

In order to accomplish the above objective, the coil device of the present invention comprises: an outside magnetic substance forming an endless loop, ah inside magnetic substance formed inside of the outside magnetic substance, and a coil wound on the periphery of the inside magnetic substance. In the coil device comprised as above and having gaps between said outside magnetic substance and said inside magnetic substance, the coil device is characterized in that it provides notches or holes in the outside magnetic substance where said notches or holes correspond to both end surfaces of the inside magnetic substance, wherein a jig can be inserted through said notches or holes so as to adjustably move the position of the inside magnetic substance. Said notches are U-shaped or triangle-shaped, and said holes are through holes such as round or square in shape.

In the coil device of the present invention structured as in the foregoing, the position of the inside magnetic substance can be adjustably moved by inserting and pressing a bar-like jig through the notches or holes provided in the outside magnetic substance. Thus, it has become possible to adjust the value of the inductance about 25% experimentally.

Therefore, even with positioning errors obtained while assembling the choke coils or the transformers, the dimensional errors of the magnetic core, or the errors caused during the process of forming the gaps, the present invention provides highly accurate inductance values and to provide the choke coils or the transformer having less variation in inductance by performing said adjustment in the final test process.

BRIEF DESCRIPTION OF THE DRAWINGS

FIG. 1 is a plan view of a combination of a □-shaped outside magnetic substance, I-shaped inside magnetic substance and a coil.

FIG. 2 is a plan view showing a H-shaped inside magnetic substance.

FIG. 3 is a plan view showing a hexagon-shaped outside magnetic substance.

FIG. 4 is a plan view showing a toroidal-shaped outside magnetic substance.

FIG. 5 is a side view of the outside magnetic substance described in FIGS. 1–4.

FIG. 6 is a side view of the outside magnetic substance having a hole.

FIGS. 7 and 8 are plan views of the coil device which utilizes bobbins.

FIG. 10 is a perspective view of an example of coil devices in accordance with the present invention.

DESCRIPTION OF THE PREFERRED EMBODIMENTS

In the following, the preferred embodiments of the present invention are described in detail.

Figure 1:
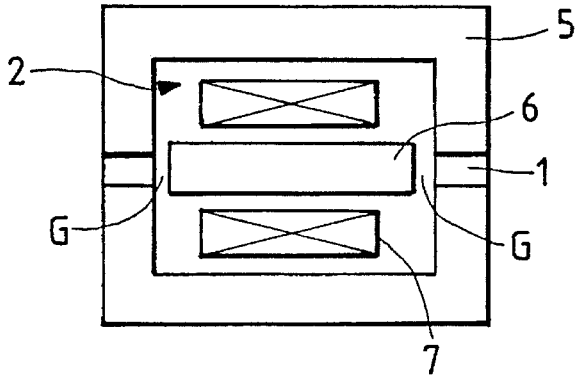
FIGS. 1–8, and 10 are embodiments of the present invention.

The coil device in FIG. 1 is comprised of the □-shaped outside magnetic substance 5 which forms a closed magnetic path and a coil device 2 having a coil 7 wound on a bar-like inside magnetic substance 6 which is provided inside of the outside magnetic substance 5. There are two predetermined gaps G provided between both ends of the inside magnetic substance 6 and the outside magnetic substance 5. On the surface of the outside magnetic substance 5, notches 1 are formed for insertion of the jig, wherein these notches are adapted to correspond to the two gaps G provided in the both ends of the inside magnetic substance 6. Each of said magnetic substances 5 and 6 are made from-the ferrite magnetic core material. The outside magnetic substance 5 is a square tube in shape, and the shape of the inside magnetic substance 6 is either a round bar, plate-like or a rectangular parallelepiped.

Figure 2:
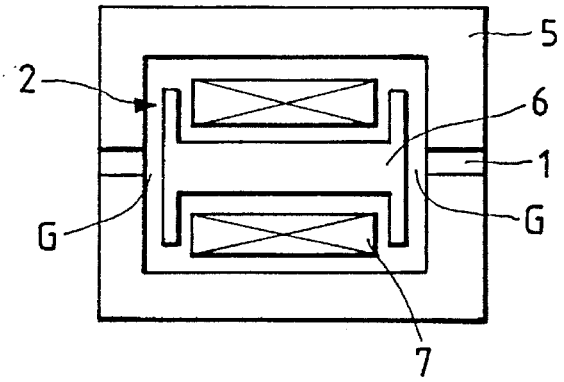

FIG. 2 shows a coil device 2, wherein the coil 7 is wound on the H-shaped inside magnetic substance 6 which is provided inside of the □-shaped outside magnetic substance 5.

Figure 3:
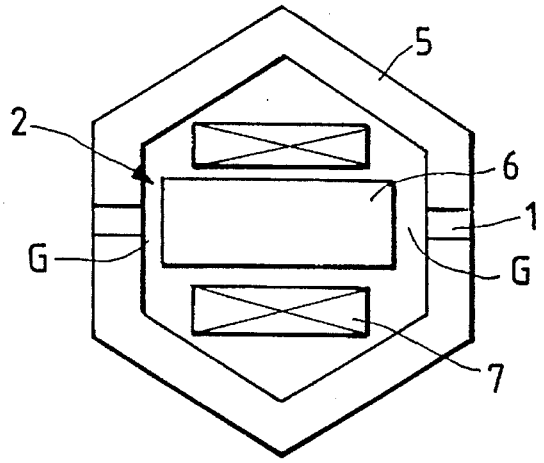
Figure 4:
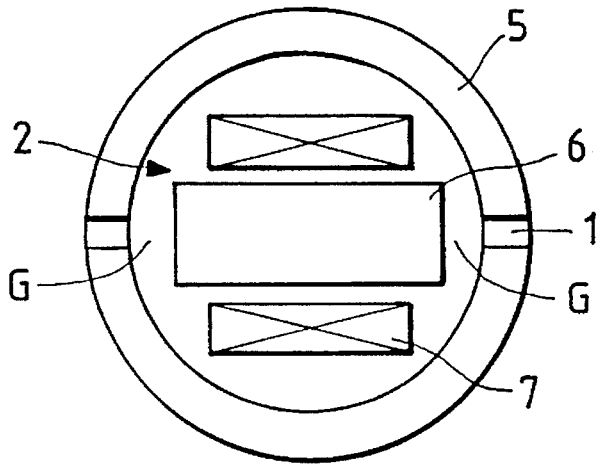

Reference numeral G shows the gaps as described in the foregoing. H-shaped inside magnetic substance 6 is comprised of a drum-shaped or a square-shaped core. FIG. 3 shows a hexagon-shaped outside magnetic substance 5. FIG. 4 shows one utilizing a toroidal-shaped core as the outside magnetic substance 5.

The embodiments shown in FIGS. 1–4 are structured so as to adjust the gaps G by inserting and pressing the jig through the notches 1. Since the gaps G are very small, for example, less than 1 mm, in this kind of coil devices, it is usually not feasible to insert the jig directly into the gaps. Thus, it is necessary to press the inside magnetic substance in a horizontal direction by a rod like jig through the notches 1.

Figure 10:
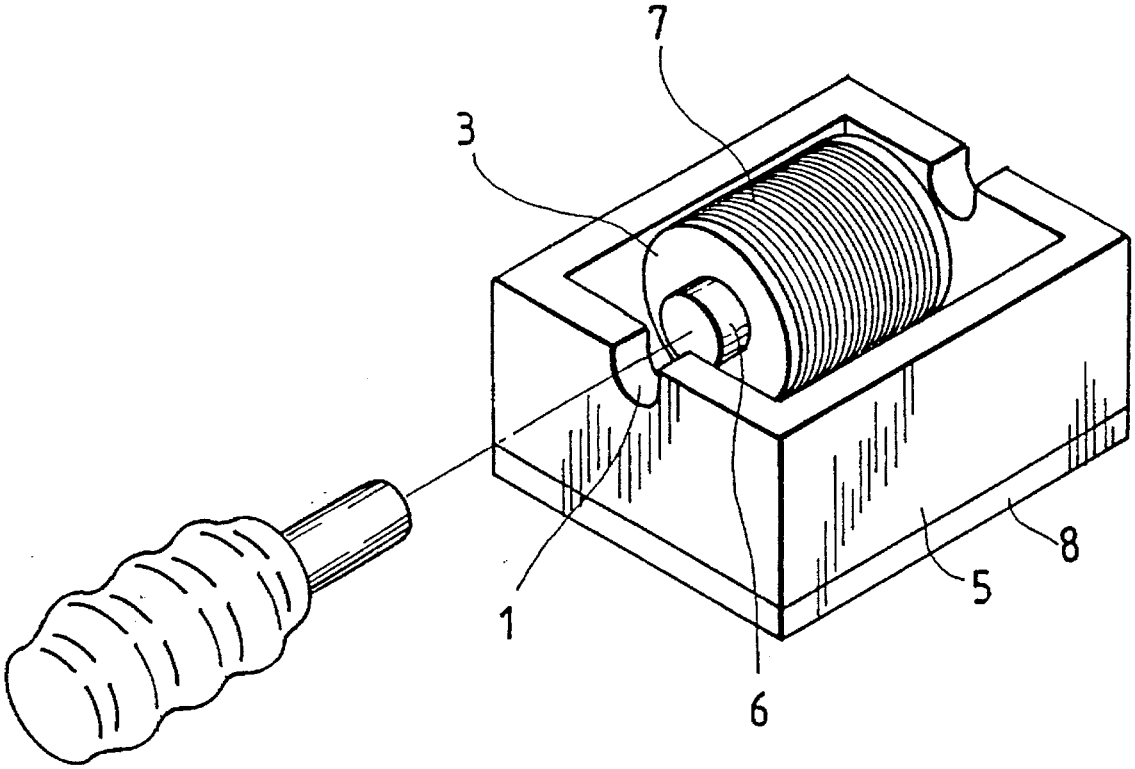

An example of overall shape of the coil devices in accordance with the present invention is illustrated in a perspective view of FIG. 10. In FIG. 10, the outside magnetic substance 5 and the inside magnetic substance 6 are mounted on a base 8. The coil 7 is wound around a bobbin 3 which is mounted on the inside magnetic substance 6. A set comprising the coil 7, the bobbin 3 and the inside magnetic substance 6 is provided with, for example, adhesive resin to be molded with respect to the base 8 after adjustment of the inductance value through exposure to heat or ultraviolet light. In this configuration, the gaps G will be adjusted by inserting the jig through the notch 1 and pressing the inside magnetic substance 6 as shown in FIG. 10. After the adjustment, the position of the inside magnetic substance with respect to the outside magnetic substance is fixed by hardening the adhesive resin as described above.

Figure 5:
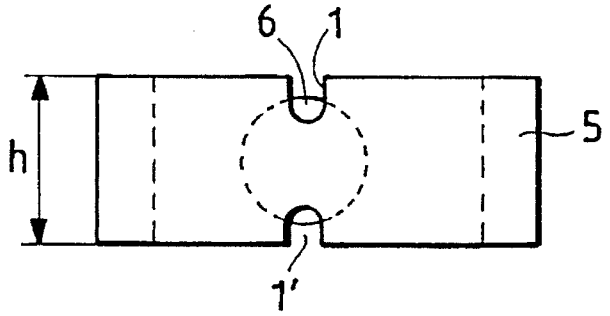

The notches 1 shown in the embodiments are U-shaped notches as shown in FIG. 5. The depth of the notches is designed so that a part of the inside magnetic substance 6 is visible from the outside. As shown in FIG. 5, if the notches 1 and 1' are provided in both the upper and the lower directions of a height h, the adjustment of the gaps becomes much easier. The notches 1 and 1' can be shaped as an inverted triangle, a semicircle or and a half square.

Figure 6:
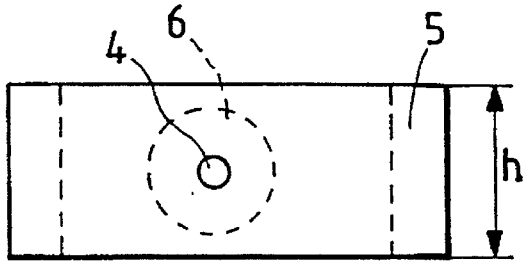

Furthermore, instead of having the notches 1 and 1', a hole 4 in the center of the outside magnetic substance 5, as shown in FIG. 6, can be provided so that the jig can be inserted therein. Also, the shape of the hole can be a triangle or a polygon.

Figure 7:
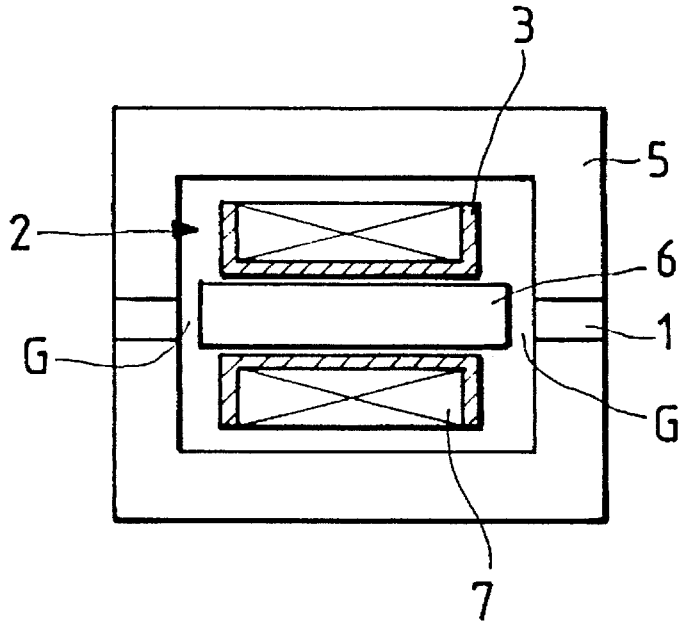
Figure 8:
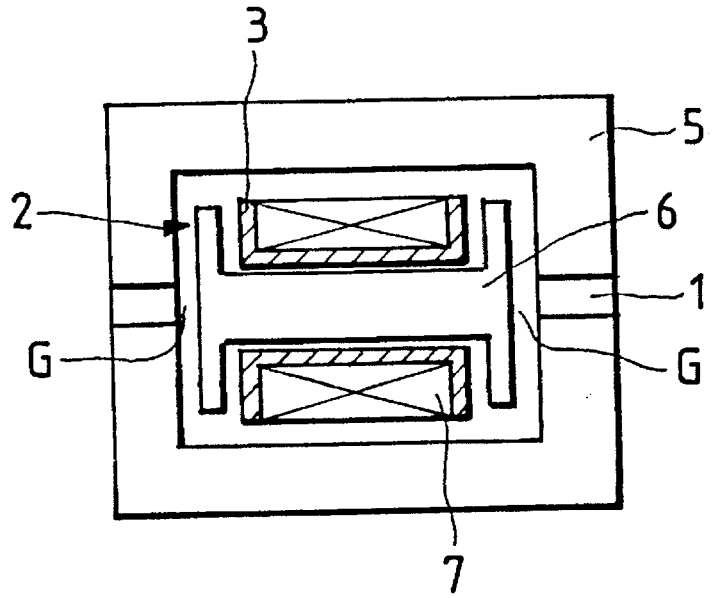

The foregoing embodiments show the structure of the inside magnetic substance 6 in which the coil 7 is directly wound. However, as shown in FIGS. 7 and 8, it is also possible to have a structure whereby the coil 7 is wound through bobbins 3. The bobbins have flanges in both ends and are assembled in order to change the relative position of the coil with respect with the inside magnetic substance 6. Therefore, by employing these embodiments, it is possible not only to change the relative position (the gaps G) between the inside magnetic substance 6 and the outside magnetic substance 5 with insertion of the jig into the notches 1, but also to change the relative position between the inside magnetic substance 6 and the coil 7 by pressing the flanges of the bobbins 3. It is also possible to provide the features to the embodiments shown in FIGS. 3 and 4 by employing the bobbins 3.

Furthermore, when providing the hole shown in FIG. 6 instead of the notches 1, wherein multiple holes are provided in the upper and the lower sides, one of the holes can be used for moving the inside magnetic substance 6, and the other one can be used for moving the bobbin in which the coil is wound. With this method, each of the inside magnetic substance and the bobbins can be moved and adjusted freely.

Figure 9:
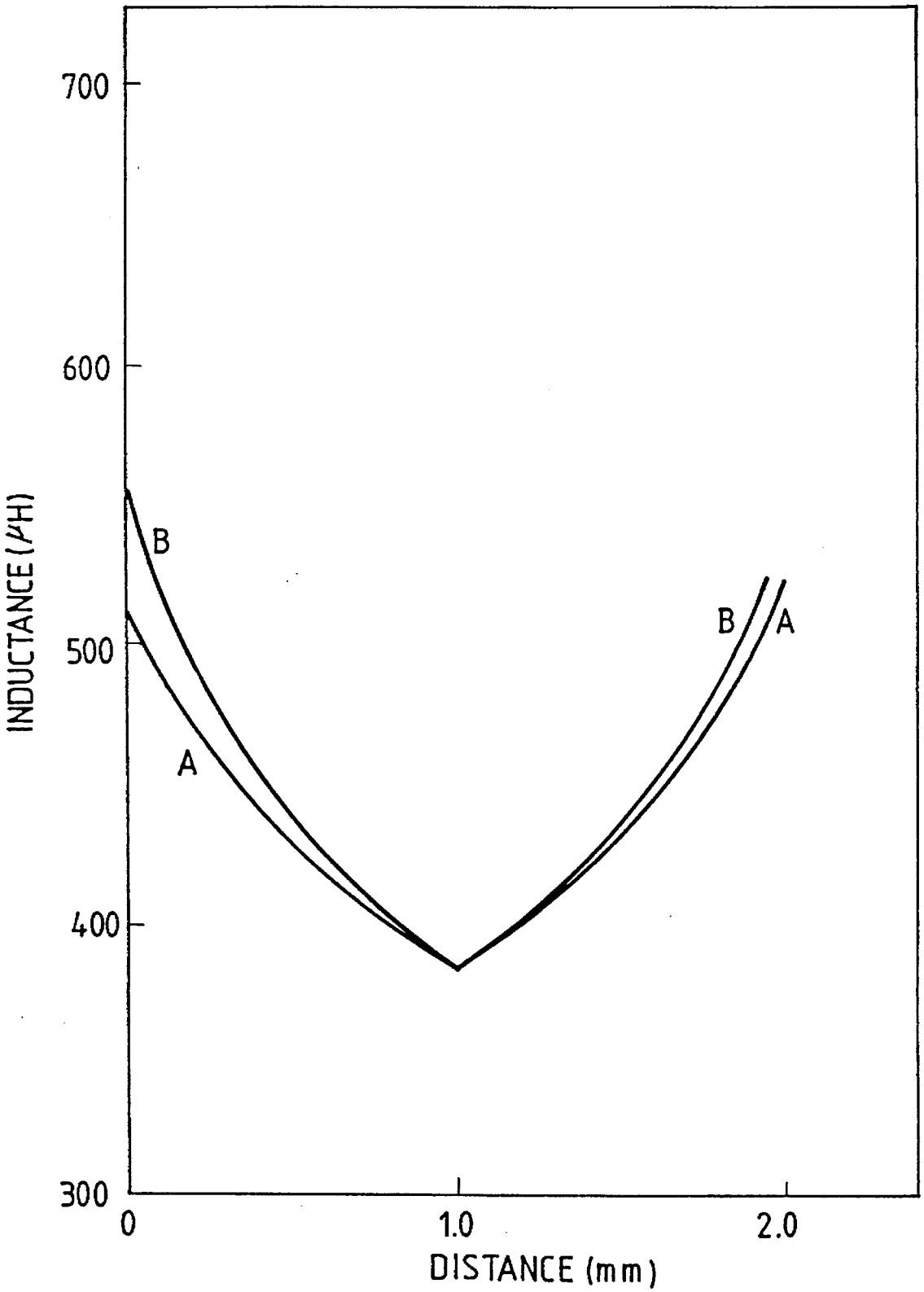
FIG. 9 is a variable diagram showing the value of the inductance when the inside magnetic substance is moved or both the inside magnetic substance and the coil are moved.

FIG. 9 is a diagram showing the test result of the adjustment of the inductance when using the coil device of the present invention. The cross axis of the diagram shows the distance between the outside magnetic substance and the inside magnetic substance in millimeters (mm), and the transverse axis shows the inductance. A curve A shows a case when only the inside magnetic substance is moved, and a curve B shows a case when the inside magnetic substance and the coil are moved.

As a result, it has been confirmed that the curve A has a variable range of 29.2%, and the curve B has that of 38.4%. In short, both of the curves A and B have the large variable ranges, especially the curve B, when compared to conventional inventions, and it means that even large errors can be precisely adjusted.

With the above described coil device, after the inside magnetic substance 6 having the coil 7 wound therein is placed into the outside magnetic substance 5 and the value of the inductance is measured, and if the errors (the errors in measurement against the expected values) are found, it is possible to adjust the errors by moving the position of the inside magnetic substance 6 with insertion of the jig into the hole 4 (that is, the gaps G are adjusted therein). Or if a bobbin is utilized, it is also possible to adjust the errors not only by moving the inside magnetic substance 6, but also by pressing the bobbin 3 so as to change the position between the coil 7 and the inside magnetic substance 6. Therefore, it is possible to obtain products having smaller variations in the inductance even when a large number of coil devices are produced.

What is claimed is:

1. A method of adjusting inductance of a coil device, said method comprising the steps of:

forming a first access inlet in an outside magnetic substance, said outside magnetic substance forming an endless loop of magnetic circuit;

arranging an inside magnetic substance inside said outside magnetic substance;

winding a coil around a bobbin movably mounted on said inside magnetic substance;

forming a second access inlet in said outside magnetic substance so as to be adjacent said bobbin;

providing at least one gap in a position corresponding to said inlet between said outside magnetic substance and said inside magnetic substance;

measuring the inductance of said coil device;

adjusting the inductance of said coil device by inserting an adjustment tool through said access inlet in order to vary the size of said gap; and further adjusting the inductance of said coil device by inserting said adjustment tool through said second access inlet in order to adjust the position of said bobbin.

2. A method of adjusting inductance of a coil device as defined in claim 1, further comprising the step of fixing the position of said inside magnetic substance relative to said outside magnetic substance.

3. A method of adjusting inductance of a coil device as defined in claim 2, wherein said position of said inside magnetic substance relative to said outside magnetic substance is fixed by means of an adhesive resin.

4. A method of adjusting inductance of a coil device as defined in claim 1, wherein said outside magnetic substance has a continuous endless structure.

5. A method of adjusting inductance of a coil device as defined in claim 1, wherein said outside magnetic substance and said inside magnetic substance form two gaps at both ends of said inside magnetic substance, said adjusting tool driving said two gaps at the same time.

6. A method of adjusting inductance of a coil device as defined in claim 5, wherein at least two access inlets are formed is said outside magnetic substance, each of said access inlets introduces said adjusting tool to each of said two gaps.

7. A method of adjusting inductance of a coil device as defined in claim 1, wherein said inductance is adjusted by solely moving said inside magnetic substance while maintaining the relative position between said outside magnetic substance and said bobbin constant.

8. A method of adjusting inductance of a coil device as defined in claim 1, wherein said inductance is adjusted by moving said inside magnetic substance and said bobbin together relative to said outside magnetic substance while maintaining the relative position between said inside magnetic substance and said bobbin constant.

9. A method of adjusting inductance of a coil device as defined in claim 1, wherein said inductance is adjusted by solely moving said bobbin around which said coil is wound while maintaining the relative position between said outside magnetic substance and said inside magnetic substance constant.

* * * * *